US007134922B2

(12) United States Patent
Kim

(10) Patent No.: US 7,134,922 B2
(45) Date of Patent: Nov. 14, 2006

(54) WIRE CONNECTING APPARATUS FOR A MAGNETIC CONTACTOR

(75) Inventor: Jun-Ho Kim, Chungcheongbuk-Do (KR)

(73) Assignee: LS Industrial Systems Co., Ltd., Seoul (KR)

( * ) Notice: Subject to any disclaimer, the term of this patent is extended or adjusted under 35 U.S.C. 154(b) by 0 days.

(21) Appl. No.: 11/296,305

(22) Filed: Dec. 8, 2005

(65) Prior Publication Data

US 2006/0128232 A1 Jun. 15, 2006

(30) Foreign Application Priority Data

Dec. 9, 2004 (KR) ..... 20-2004-0034977

(51) Int. Cl.
*H01R 4/36* (2006.01)

(52) U.S. Cl. ..... 439/814; 439/709

(58) Field of Classification Search ..... 439/814, 439/810, 813, 709; 335/220
See application file for complete search history.

(56) References Cited

U.S. PATENT DOCUMENTS 3,050,706 A * 8/1962 Kitscha ..... 439/781
3,081,507 A * 3/1963 Gribble ..... 403/389
5,934,948 A * 8/1999 Hiramatsu et al. ..... 439/781
5,994,989 A * 11/1999 Rowe et al. ..... 335/202
6,293,812 B1 * 9/2001 Ewer et al. ..... 439/107
6,531,941 B1 * 3/2003 Greenberg et al. ..... 335/202
6,632,108 B1 * 10/2003 Hohlfelder ..... 439/709
6,683,251 B1 * 1/2004 Brant et al. ..... 174/53
6,733,347 B1 * 5/2004 Palet Mercader et al. .. 439/810
6,930,577 B1 * 8/2005 Subramanian et al. ..... 335/202

* cited by examiner

*Primary Examiner*—Tulsidas C. Patel
*Assistant Examiner*—Vlaadimir Imas
(74) *Attorney, Agent, or Firm*—Greenblum & Bernstein, P.L.C.

(57) ABSTRACT

A wire connecting apparatus for a magnetic contactor comprises a plurality of wire connector assemblies, a frame for supporting the wire connector assemblies, and a plurality of terminals connected to an external wire. The external wire can be simply connected to the terminal by just tightening or releasing a screw, thereby simplifying an entire wiring process and enhancing a work efficiency.

12 Claims, 5 Drawing Sheets

WIRE CONNECTING APPARATUS FOR A MAGNETIC CONTACTOR

BACKGROUND OF THE INVENTION

1. Field of the Invention

The present invention relates to a wire connecting apparatus for a magnetic contactor, and more particularly, to a screw-type wire connecting apparatus for a magnetic contactor capable of providing an efficient wire connecting work.

2. Description of the Conventional Art

Generally, a magnetic contactor is a component of an electric power distribution board or a system such as a driving/controlling device of a motor. The magnetic contactor is connected to a wire connected to a system circuit, and opens and closes a circuit on the system.

The magnetic contactor has a certain lifespan according to a usage circumstance such as a usage purpose and a switching frequency. Therefore, in an electric power distribution board where a plurality of electronic contactors are installed or in a system such as a driving/controlling device of a motor where a magnetic contactor or a wire connecting of a magnetic contactor has to be changed, connecting a terminal of a magnetic contactor to an external wire connected to of the system circuit is frequently required.

The magnetic contactor is provided with a wire connecting apparatus connected to the external wire of the system. The wire connecting apparatus can be sorted into a screw-type apparatus and a lug-type apparatus.

Generally, in Asia where an external wire having a ring-shaped compression terminal or a U-shaped compression terminal is applied, a screw-type wire connecting apparatus is mainly used. On the contrary, in Europe and U.S.A, a lug-type wire connecting apparatus is mainly used.

In a magnetic contactor having a low rated current less than 25 ampere, a screw-type wire connecting apparatus is applied. In the screw-type wire connecting apparatus, in case of using an ordinary wire or a wire having a U-shaped terminal at a leading end of the wire as an external wire of the system, the external wire can be connected to the wire connecting apparatus just by releasing a screw and then by tightening the screw.

However, in the screw-type wire connecting apparatus, in case of using a wire having a ring terminal at a leading end thereof so as to be connected to a terminal of a magnetic contactor, the screw has to be completely separated from the terminal of the magnetic contactor. Then, a screw hole of the magnetic contactor terminal is aligned with a hole of the ring terminal, or a screw is inserted into the ring terminal. Then, the magnetic contactor terminal has to be coupled with the ring terminal by a screw.

In order to connect the ring terminal to the screw-type wire connecting apparatus, various tools or two workers are necessary. Accordingly, the number of wiring processes is increased, and a work productivity is lowered.

BRIEF DESCRIPTION OF THE INVENTION

Therefore, an object of the present invention is to provide a wire connecting apparatus for a magnetic contactor capable of enhancing a productivity and shortening a wiring time by connecting an external wire to a terminal of a magnetic contactor without detaching a screw from the wire connecting apparatus.

To achieve these and other advantages and in accordance with the purpose of the present invention, as embodied and broadly described herein, there is provided a wire connecting apparatus for a magnetic contactor, comprising: a plurality of wire connector assemblies; a frame for supporting the wire connector assemblies; and a plurality of terminals connected to an external wire, in which the wire connector assembly comprises: a screw including a head portion, a threaded portion, and a flat surface portion between the head portion and the threaded portion and screw-coupled to the terminal or detached from the terminal, for connecting the external wire to the terminal or detaching the external wire from the terminal; a washer installed at the flat surface portion of the screw for preventing the screw from being detached and widening a contact area between the external wire and the terminal;

a screw supporter including an upper plate having a groove portion for supporting the screw, a lower plate, and a connection portion for connecting the upper plate to the lower plate and installed at the frame to be perpendicularly movable, for supporting the screw and the washer to be prevented from vertically detaching therefrom; and a supporter spring having one end supported by the screw supporter and the other end supported by the frame, for providing an elastic force to the screw supporter in an upper direction.

The foregoing and other objects, features, aspects and advantages of the present invention will become more apparent from the following detailed description of the present invention when taken in conjunction with the accompanying drawings.

BRIEF DESCRIPTION OF THE DRAWINGS

The accompanying drawings, which are included to provide a further understanding of the invention and are incorporated in and constitute a part of this specification, illustrate embodiments of the invention and together with the description serve to explain the principles of the invention.

In the drawings.

DETAILED DESCRIPTION OF THE INVENTION

Reference will now be made in detail to the preferred embodiments of the present invention, examples of which are illustrated in the accompanying drawings.

Hereinafter, a wire connecting apparatus for a magnetic contactor according to the present invention will be explained with reference to the attached drawings.

Figure 1:
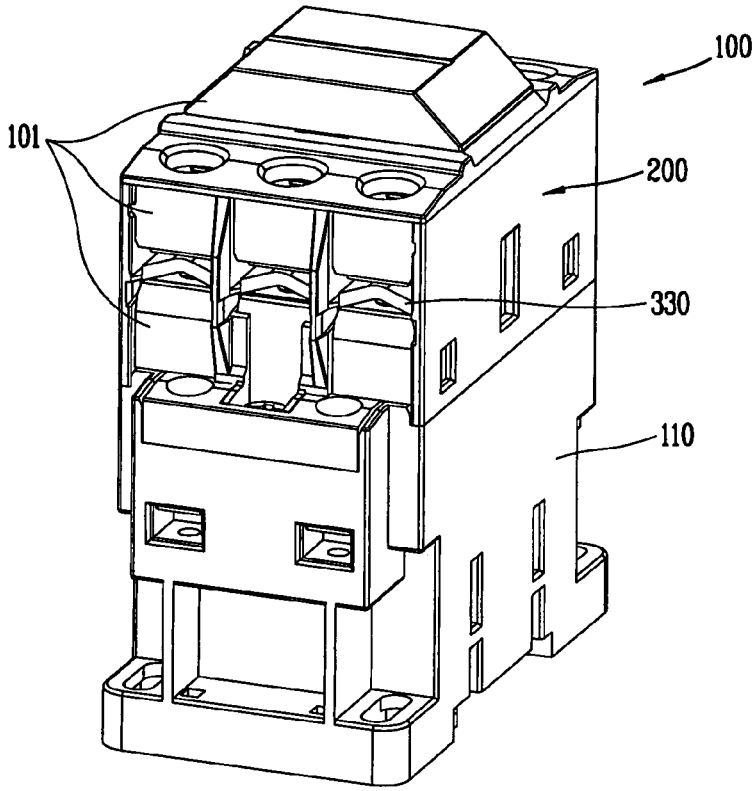
FIG. 1 is a perspective view showing a magnetic contactor having a wire connecting apparatus according to a first embodiment of the present invention.

FIG. 1 is a perspective view showing a magnetic contactor 100 having a wire connecting apparatus 200 according to a first embodiment of the present invention. Referring to FIG. 1, a lower frame 110 of the magnetic contactor 100 is coupled to an upper frame 210 of a magnetic contactor 200 of FIG. 2. A dust cover 101 for preventing dust from being introduced to the upper frame 210 is mounted at the upper frame 210. In FIG. 1, only a washer 330 is shown since the wire connecting apparatus 200 is covered by the dust cover 101.

Figure 2:
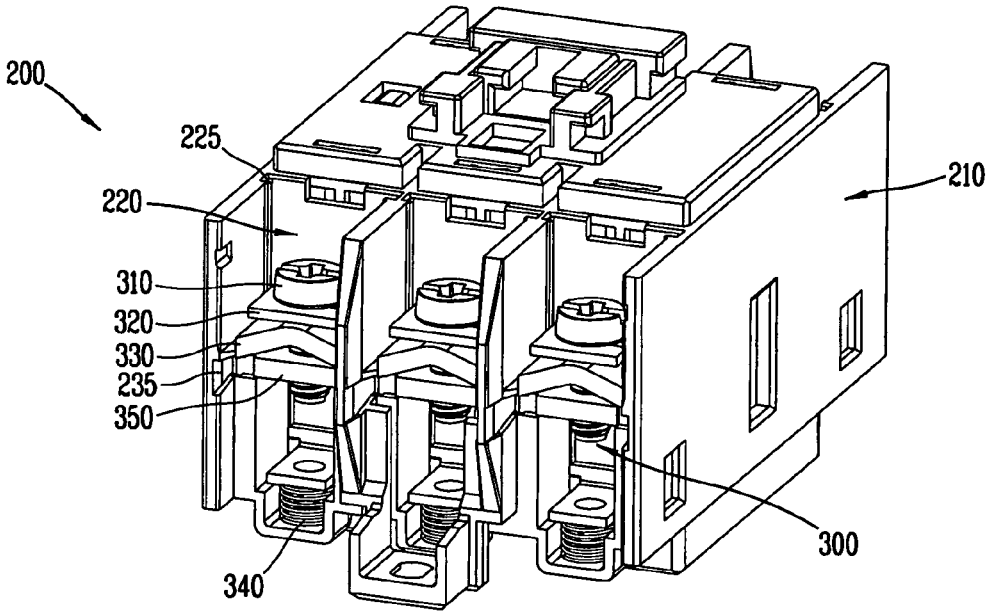
FIG. 2 is a perspective view showing an upper frame of the magnetic contactor having a wire connecting apparatus according to a first embodiment of the present invention.

FIG. 2 is a perspective view showing an upper frame of the magnetic contactor having a wire connecting apparatus according to a first embodiment of the present invention.

Referring to FIG. 2, the wire connecting apparatus 200 for a magnetic contactor according to the present invention comprises three wire connector assemblies 300, an upper frame 210 for supporting the wire connector assemblies 300, and a terminal 350 for connecting a magnetic contactor to an external wire on a circuit.

The wire connector assembly 300 comprises a screw 310 for connecting a wire to the terminal 350, a screw supporter 320 for supporting the screw 310, a washer 330 installed at the screw 310 for preventing the screw 310 from being detached from the screw supporter 320 and widening a contact area between the external wire and the terminal, and a supporter spring 340 installed at a lower end of the screw supporter 320.

An unexplained reference numeral 220 designates a receiving portion installed on the upper frame 210 for receiving the wire connector assembly 300. Also, an unexplained reference numeral 225 designates a guide slit installed on the upper frame 210 for guiding the screw supporter to be moved in a perpendicular direction.

Figure 3:
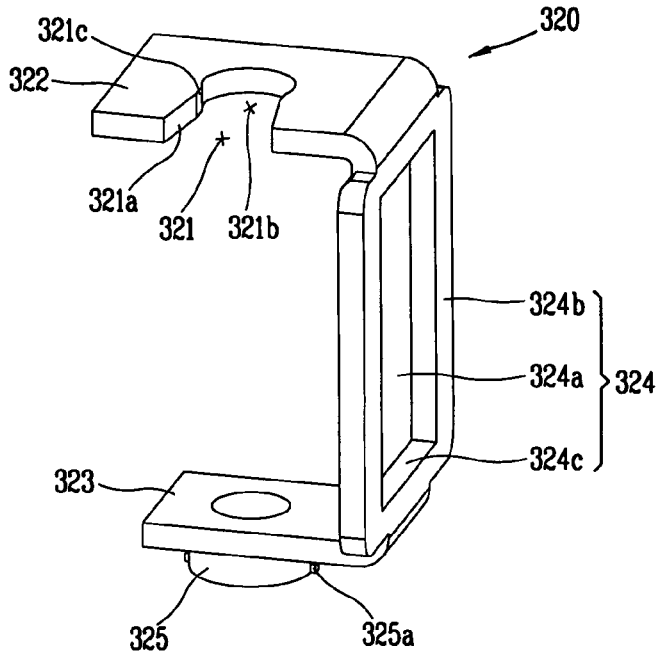
FIG. 3 is a perspective view showing a screw supporter of the wire connecting apparatus according to the present invention.

FIG. 3 is a perspective view showing the screw supporter of the wire connecting apparatus according to the present invention. The screw supporter 320 will be explained in more detail with reference to FIG. 3.

The screw supporter 320 comprises an upper plate 322 having a groove portion 321 for supporting the screw 310, a lower plate 323, and a connection portion 324 for connecting the upper plate 322 to the lower plate 323.

The groove portion 321 of the upper plate 322 is provided with a pair of inclined surfaces 321*a* having a decreasing width towards an inner side thereof for guiding the inserting of the screw 310 at an entrance thereof. A supporting portion 321*b* for mounting the inserted screw 310 is extending from the inclined surface 321*a* at an inner side of the groove portion 321. A pair of neck portions 321*c* for preventing the screw 310 inserted into the supporting portion 321*b* from being detached from the supporting portion 321*b* are provided between the inclined surface 321*a* and the supporting portion 321*b*.

A head portion 310*a* of the screw 310 is mounted at an upper surface of the upper plate 322. A flat surface portion 310*c* where the threaded portion 310*b* is not formed is inserted into the supporting portion 321*b*. The supporting portion 321*b* has a partial circular shape having a diameter equal or a little larger to/than a diameter of the flat surface portion 310*c* of the screw 310. A gap between the two neck portions 321*c* is equal or smaller to/than the diameter of the flat surface portion 310*c*.

The connection portion 324 is provided with a rectangular through hole 324*a* for passing the terminal 350 at the center thereof. The connection portion 324 is integrally formed at each edge of the upper plate 322 and the lower plate 323 in a perpendicular direction to the upper plate 322 and the lower plate 323. The connection portion 324 has a rectangular shape having a vertical edge longer than a horizontal edge, a window frame shape.

The connection portion 324 comprises a pair of vertical frames 324*b* parallel with each other, and a horizontal frame 324*c* for connecting both ends of the vertical frames 324*b*.

The vertical frame 324*b* connects the upper plate 322 to the lower plate 323, and couples the wire connector assembly 300 to the receiving portion 220 provided at the upper frame 210 of the wire connecting apparatus 200.

Therefore, a width between the two vertical frames 324*b*, that is, a length of the horizontal frame 324*c* is longer than a width of the upper plate 322 and the lower plate 323 to be coupled to the upper frame 210.

A supporting boss 325 for supporting an upper end of the supporter spring 340 is integrally formed at a lower surface of the lower plate 323 downwardly. Two spring supporting protrusions 325*a* protruding from an outer circumferential surface of the supporting boss 325 for preventing the supporter spring 340 from being detached therefrom are provided.

Figure 4:
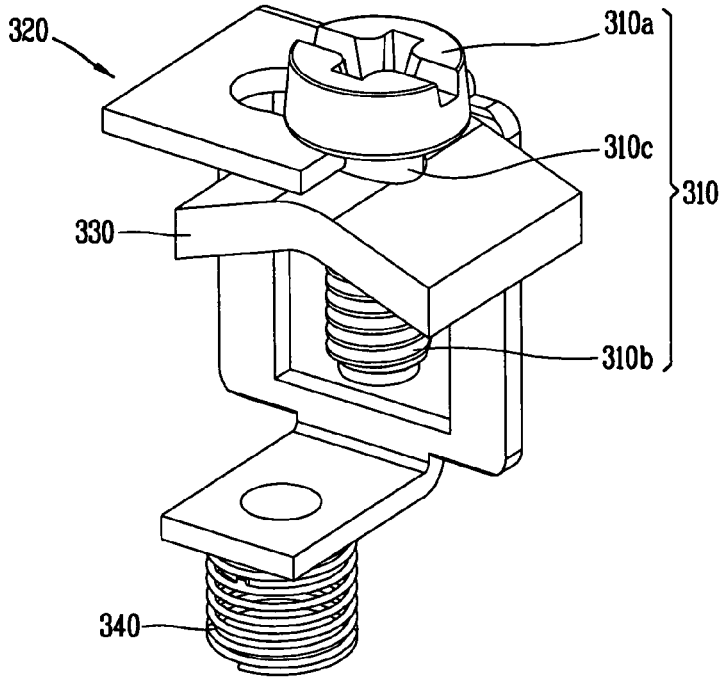
FIGS. 4 and 5 are perspective views showing a process for completing a wire connector assembly by assembling a supporter spring, a screw, and a washer to the screw supporter of FIG. 3.
Figure 5:
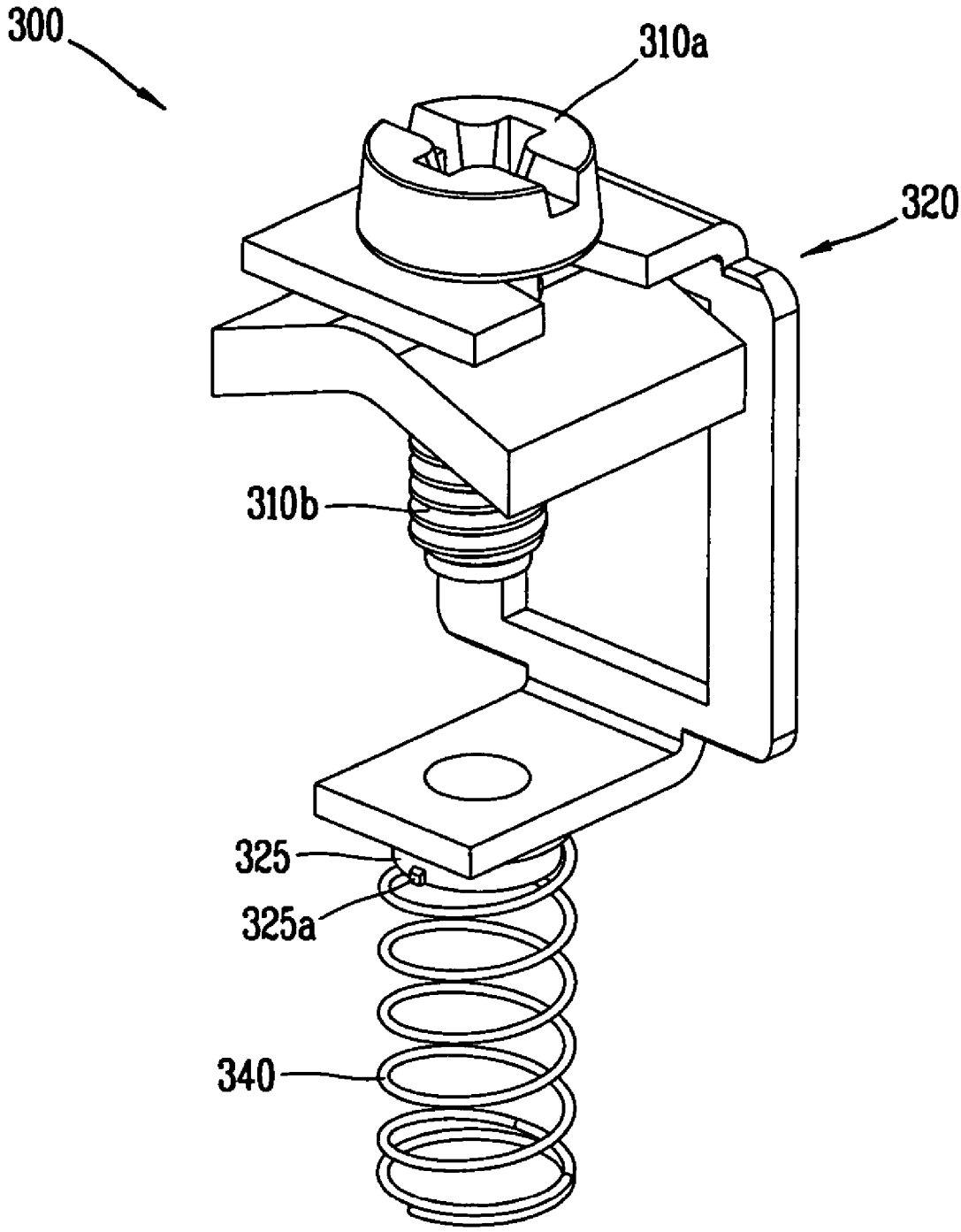

Referring to FIGS. 4 and 5, will be explained a construction of the screw 310, a process for installing and supporting the screw 310 and the washer 330 to the screw supporter 320, and a process for installing the supporter spring 340 to the supporting boss 325 of the lower plate 323.

The screw 310 comprises the head portion 310*a* and the body portion.

The head portion 310*a* is provided with a groove portion for inserting a tool such as a driver at an upper surface thereof, and has a diameter larger than a diameter of the body portion. The body portion is integrally extending from a lower surface of the head portion 310*a* in a perpendicular direction. The body portion includes a threaded portion 310*b* having a threaded surface at an outer circumferential surface thereof, and a flat surface portion 310*c* formed between the head portion 310*a* and the threaded portion 310*b*.

The screw 310 is installed at the screw supporter 320, and is coupled to the terminal 350 of the wire connecting apparatus 200. The washer 330 is installed at the flat surface portion 310*c* of the screw 310 in order to prevent the screw 310 from being detached from the screw supporter 320 in a vertical direction and in order to minimize an electrical resistance by widening a contact area between the terminal 350 and the external wire 400 of FIG. 7.

A length of the flat surface portion 310*c* is longer than a sum between a thickness of the washer 330 and a thickness of the upper plate 322 of the screw supporter 320 due to the following reason. As shown in FIG. 4, when the screw 310 and the washer 330 are installed at the screw supporter 320, the upper plate 322 of the screw supporter 320 is inserted between the washer 330 and the head portion 310*a* at the entire length of the flat surface portion 310*c* except the thickness of the washer 330.

A process for installing the screw 310 and the washer 330 at the screw supporter 320 will be explained.

Under a state that the screw 310 and the washer 330 are coupled to each other, the flat surface portion 310*c* below the head portion 310*a* of the screw 310 is positioned in the groove portion 321 formed at the upper plate 322 of the screw supporter 320. Then, the screw 310 is inserted into the neck portion 321*c* having a diameter shorter than a diameter of the flat surface portion 310*c* along the inclined surface 321*a* of the groove portion 321, so that the groove portion 321 is widened right and left. As the flat surface portion 310*c* of the screw 310 passes through the neck portion 321*c* of the groove portion 321, the head portion 310*a* of the screw 310 is mounted at the supporting portion 321*b*. The groove portion 320 widened right and left to some degree is restored to the original state, and the neck portion 321*c* prevents the screw 310 from being detached from the supporting portion 321*b* in a horizontal direction.

A process for coupling the supporter spring 340 to the screw supporter 320 will be explained. The supporting boss 325 of the lower plate 323 is positioned at an upper end of the supporter spring 340 and then is forcibly inserted into the screw supporter 320. As the result, the upper end of the supporter spring 340 is simply coupled to the spring supporting protrusion 325*a*. The supporter spring 340 coupled to the spring supporting protrusion 325*a* is not detached from the supporting boss 325.

Figure 6:
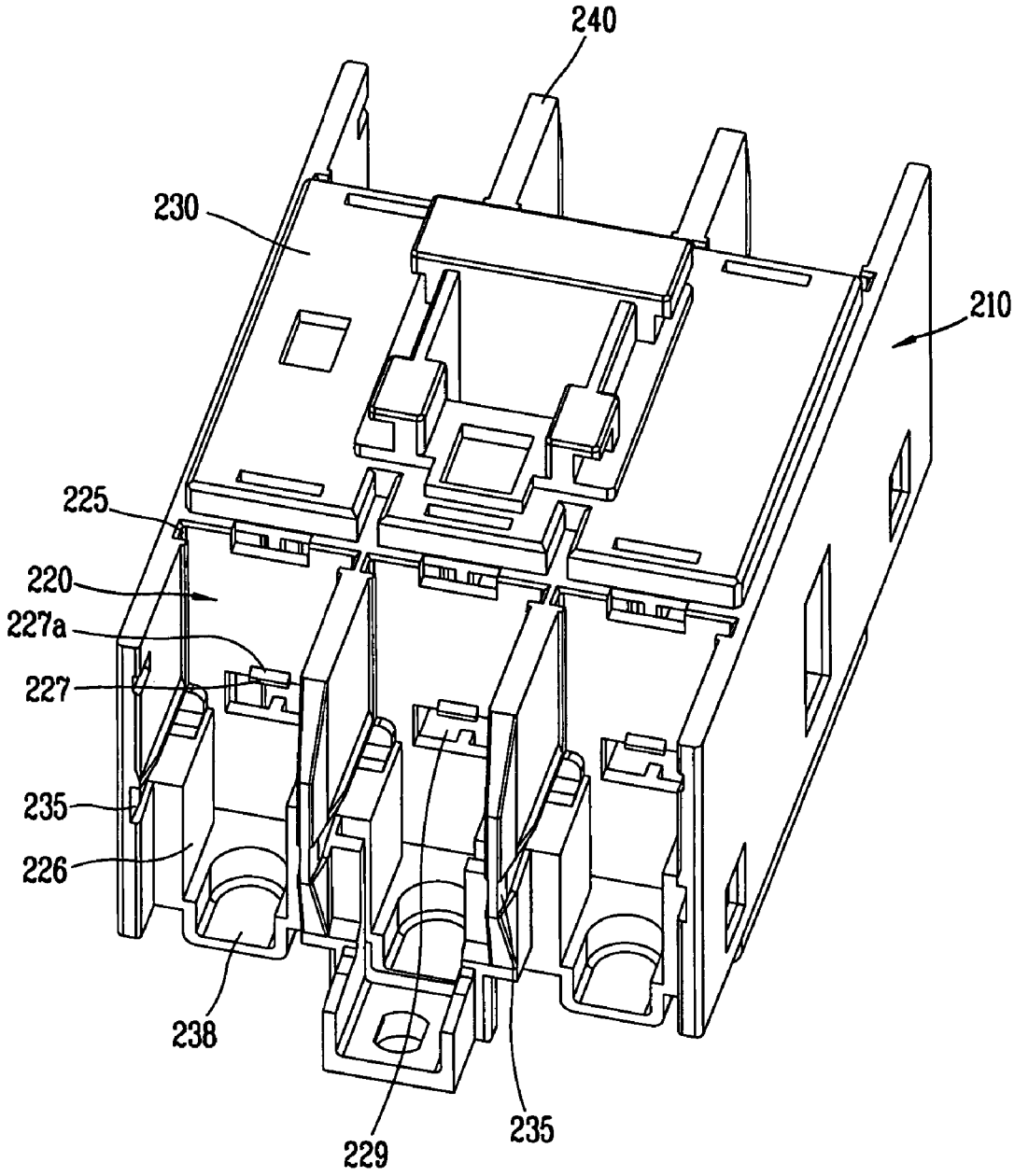
FIG. 6 is a perspective view showing a state prior to mounting a wire connector assembly and a terminal to the upper frame of the magnetic contactor according to the present invention.

FIG. 6 is a perspective view showing a state prior to mounting a wire connector assembly at the upper frame of The magnetic contactor according to the present invention. Referring to FIG. 6, the upper frame 210 and the receiving portion 220 will be explained in more detail.

The upper frame 210 of the wire connecting apparatus 200 according to the present invention comprises a body portion 230, and an insulating partition wall 240 protruding from the body 230 in a longitudinal direction and having a predetermined gap from the body in a width direction.

The insulating partition walls 240 are symmetrically disposed at both sides of the body portion 230, and the receiving portion 220 for receiving the wire connector assembly 300 is disposed between the insulating partition walls 240. That is, the insulating partition wall 240 insulates each of the wire connector assembly 300 installed at the receiving portion 220.

To the wire connector assembly 300 inside one receiving portion 220 of the body 230, an external wire for a power source is connected. Also, to the wire connector assembly 300 inside another receiving portion 220 of the body 230, an external wire for electrical load is connected.

The guide slit 225 coupled to the vertical frame 324*b* of the screw supporter 320 is formed at the receiving portion 220. The guide slit 225 is vertically provided at rear portions of both inner side surfaces of the receiving portion 220, that is, at a contact edge between one surface of the body portion 230 of the upper frame 210 and the insulating partition wall 240. A pair of the guide slits 225 are provided at each phase of an electrical current. Referring to FIG. 6, three pairs of guide slits 225 are provided at magnetic contactor for alternating current of three phases. The vertical frame 324*b* is slidably inserted into the guide slit 225, and is moved in a longitudinal direction of the guide slit 225.

A lift-limiting stopper 227 for limiting a lifting of the screw supporter 320 is protruding from one surface of the body 230 of the upper frame 210, that is, a rear surface of the receiving portion 220. Each of the lift-limiting stopper 227 is provided at six receiving portions 220. An unexplained reference numeral 227*a* designates an inclined surface of the lift-limiting stopper 227. The inclined surface 227*a* is protruding downwardly, and guides the screw supporter 320 to be downwardly moved. However, the inclined surface 227*a* does not allow the screw supporter 320 that has slid onto the inclined surface 227*a* to be upwardly moved.

A terminal insertion hole 229 for inserting a rear end of the terminal 350 is provided just below the lift-limiting stopper 227. A terminal insertion groove portion 235 for guiding the terminal 350 to be slid-inserted thereinto and supporting the terminal 350 is provided at an inner wall of the receiving portion, that is, an inner wall of the insulating partition wall at the same height as the terminal insertion hole 229.

A pair of spring supporting walls 226 facing each other and protruding from the insulating partition wall 240 for supporting the supporter spring 240 are formed at a lower portion of each receiving portion 220, that is, just below the terminal insertion groove portion 235.

A spring seat portion 238 downwardly concaved for supporting a lower end of the supporter spring 340 is provided at a bottom surface of the receiving portion 220.

Figure 7:
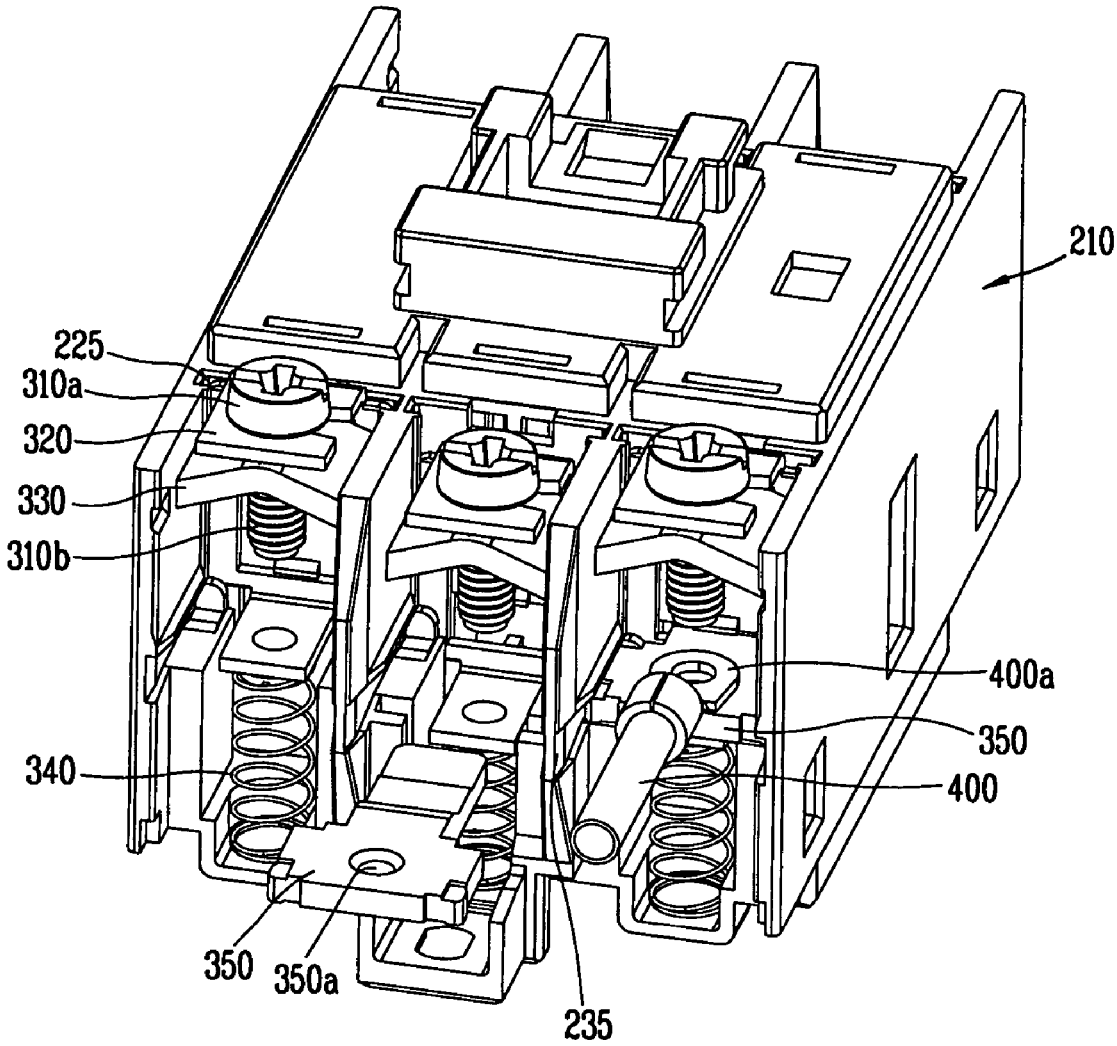
FIG. 7 is a perspective view showing a process for installing and connecting a wire connector assembly, a terminal, and an external wire to the upper frame according to the present invention.

Referring to FIG. 7, a process for installing the wire connector assembly 300 and the terminal 350 at the receiving portion 220 of the upper frame 210 and connecting the external wire 400 to the terminal 350 by the wire connector assembly 300 will be explained.

The wire connector assembly 300 is installed at the receiving portion 220 as follows.

The screw 310, the washer 330, and the supporter spring 340 are assembled to the screw supporter 320, thereby providing the wire connector assembly 300. The vertical frame 324*b* of the connection portion 324 of the screw supporter 320 is inserted into the guide slit 225 of the receiving portion 220. Then, an upper portion of the wire connector assembly 300, that is, the head portion 310*a* of the screw 310 is downwardly pressed. Desirably, an opening of the groove portion 321 of the upper plate 322 is positioned towards the insulating partition wall 240 so as to prevent the screw 310 from being horizontally detached from the screw supporter 320.

The terminal 350 is slid along the guide slit 225 thus to be downwardly moved. When the terminal 350 comes in contact with the inclined surface 227*a* of the lift-limiting stopper 227, the terminal 350 is temporarily stopped.

When the head portion 310*a* of the screw 310 is pressed more strongly, the horizontal frame 324*c* climbs over the inclined surface 227*a*, so that the wire connector assembly 30 is moved more downwardly.

When a lower end of the supporter spring 340 comes in contact with the spring seat portion 238, the pressurization onto the terminal 350 is stopped. As the result, the wire connector assembly 300 is lifted by an elastic force of the supporter spring 340. However, since an upper surface of the horizontal frame 324*c* is stopped by the lift-limiting stopper 227, the wire connector assembly 300 is stopped thereby to be positioned in the receiving portion 220.

The process for installing the terminal 350 at the upper frame 210 and electrically and mechanically connecting the external wire 400 to the terminal 350 by using the screw 310 will be explained.

First, a rear end of the terminal 350 is inserted into the insertion groove portion 235 via the through hole 324*a* of the screw supporter 320 with pressing the head portion 310*a* of the screw 310 so that the insertion hole 229 can be exposed, thereby completing the installation of the terminal 350.

Then, the external wire 400 having a ring terminal at a leading end thereof is positioned at an upper surface of the terminal 350. The screw supporter 320 receives an elastic bias force in a vertical upper direction by the supporter spring 340. However, the screw supporter 320 is prevented from being lifted due to the terminal 350 fixed by the insertion hole 229 and the insertion groove portion 235.

Under the state, when the screw 310 is clockwise rotated while pressing the wire connector assembly 300 downwardly by using a tool such as a driver, etc., the threaded portion 310*b* of the screw 310 passes through the ring terminal hole of the external wire 400 and a screw insertion hole 350*a* of the terminal 350. Accordingly, the washer 320 comes in contact with the terminal 350. As the washer 320 having an area larger than an area of the ring terminal presses the terminal 350, a leading end 400*a* of the external wire 400, that is, the ring terminal comes in contact with the terminal 350 thereby to minimize an electrical resistance. A thread is formed at an inner circumferential surface of the screw insertion hole 350*a* of the terminal 350. The screw 310 is coupled to the screw insertion hole 350*a* of the terminal 350. Accordingly, connecting the external wire 400 to the wire, connecting apparatus 200 for a magnetic contactor 100 according to the present invention is completed.

When the tightened screw 310 is detached from the screw insertion hole 350*a* of the terminal 350 by being counter-clockwise rotated, the screw supporter 32 is automatically lifted by an elastic force of the supporter spring 340. Accordingly, the screw 310 is upwardly spaced from the terminal 350 with a predetermined distance. Since the upper surface of the horizontal frame 324*c* of the screw supporter 320 is stopped by the fixed terminal 350, a lifting of the wire connector assembly 300 is limited. Therefore, the wire connector assembly 300 is not detached from the receiving portion 220.

As aforementioned, in the present invention, the screw has only to be tightened or released at the time of connecting or detaching the wire on the circuit to/from the terminal of the wire connecting apparatus, and the wire connector assembly is not detached from the magnetic contactor. Accordingly, an operation process is simplified.

Furthermore, one worker can perform a wiring without other person's help thereby to enhance a work productivity.

As the present invention may be embodied in several forms without departing from the spirit or essential characteristics thereof, it should also be understood that the above-described embodiments are not limited by any of the details of the foregoing description, unless otherwise specified, but rather should be construed broadly within its spirit and scope as defined in the appended claims, and therefore all changes and modifications that fall within the metes and bounds of the claims, or equivalence of such metes and bounds are therefore intended to be embraced by the appended claims.

What is claimed is:

1. A wire connecting apparatus for a magnetic contactor, comprising:

a plurality of wire connector assemblies;

a frame for supporting the wire connector assemblies; and a plurality of terminals connected to an external wire, in which the wire connector assembly comprises:

a screw including a head portion, a threaded portion, and a flat surface portion between the head portion and the threaded portion and screw-coupled to the terminal or detached from the terminal, for connecting the external wire to the terminal or detaching the external wire from the terminal;

a washer installed at the flat surface portion of the screw for preventing the screw from being detached and widening a contact area between the external wire and the terminal;

a screw supporter including an upper plate having a groove portion for supporting the screw, a lower plate, and a connection portion for connecting the upper plate to the lower plate and installed at the frame to be perpendicularly movable, for supporting the screw and the washer to be prevented from vertically detaching therefrom; and a supporter spring having one end supported by the screw supporter and the other end supported by the frame, for providing an elastic force to the screw supporter in an upper direction.

2. The apparatus of claim 1, wherein the groove portion of the screw supporter comprises:

an inclined surface formed at an entrance of the groove portion for guiding inserting of the screw;

a supporting portion for mounting the head portion of the screw; and a neck portion formed between the inclined surface and the supporting portion and having a gap therebetween equal or smaller to/than a diameter of the flat surface portion of the screw, for preventing the screw inserted into the supporting portion from being detached from the supporting portion.

3. The apparatus of claim 1, wherein the lower plate of the screw supporter comprises:

a supporting boss formed at a lower surface thereof for supporting the supporter spring; and a spring supporting protrusion protruding from an outer circumferential surface of the supporting boss for preventing the supporter spring from being detached therefrom.

4. The apparatus of claim 3, wherein at least two spring supporting protrusions are provided.

5. The apparatus of claim 1, wherein the connection portion of the screw supporter has a window frame shape having a through hole for passing the terminal at a center thereof and having a horizontal frame and a vertical frame, and is integrally formed at each edge of the upper plate and the lower plate in a vertical direction.

6. The apparatus of claim 1, wherein the frame is provided with a receiving portion of the wire connector assembly, and the receiving portion is formed at a space between insulating partition walls formed at the frame with a predetermined gap.

7. The apparatus of claim 1, wherein the frame is provided with a guide slit for guiding the screw supporter to be moved in a vertical direction.

8. The apparatus of claim 7, wherein the guide slit is vertically formed at a contact edge between one surface of the frame and the insulating partition wall with a predetermined length.

9. The apparatus of claim 1, wherein a lift-limiting stopper for limiting a lifting of the screw supporter is provided at one surface of the frame, and an upper surface of the lift-limiting stopper is inclined so that the screw supporter can be guided to lower.

10. The apparatus of claim 6, wherein a spring seat portion downwardly concaved for supporting a lower end of the supporter spring is provided at a bottom surface of the receiving portion.

11. The apparatus of claim 6, wherein a spring supporting wall for supporting the supporter spring is protruding from each insulating partition wall facing each other.

12. The apparatus of claim 1, wherein a plurality of insulating partition walls for insulating each terminal are provided at the frame, and the groove portion of the upper plate of the screw supporter has an entrance towards the insulating partition wall so that the screw can be prevented from detaching from the screw supporter in a horizontal direction.

* * * * *